United States Patent [19]

Hambleton et al.

[11] Patent Number: 4,570,817

[45] Date of Patent: Feb. 18, 1986

[54] SLIDEABLE RECLOSABLE PLASTIC LID

[75] Inventors: Thomas P. Hambleton; Richard R. Triggiani, both of Pine Bush, N.Y.

[73] Assignee: International Paper Company, New York, N.Y.

[21] Appl. No.: 684,528

[22] Filed: Dec. 21, 1984

[51] Int. Cl.[4] ..... B65D 43/20

[52] U.S. Cl. ..... 220/345; 222/544; 222/585

[58] Field of Search ..... 220/345, 346, 254; 222/544, 585, 478, 456

[56] References Cited

U.S. PATENT DOCUMENTS

| | | | |
|---|---|---|---|
| 949,974 | 2/1910 | Cibulka | 220/345 |
| 1,090,264 | 3/1914 | Adams | 220/346 |
| 1,273,012 | 7/1918 | Souther | 222/456 |
| 1,323,346 | 12/1919 | Wolfe | 222/561 |
| 2,037,746 | 4/1936 | Wardell | 222/480 |
| 3,332,586 | 7/1967 | Amburgey | 220/345 |
| 3,363,798 | 1/1968 | Garangiotis | 220/345 |
| 3,889,842 | 6/1975 | Bennett | 220/253 |
| 3,938,690 | 2/1976 | Butler | 220/90.4 |
| 4,127,212 | 11/1978 | Waterbury | 220/346 |
| 4,206,854 | 6/1980 | Takami | 222/478 |

*Primary Examiner*—George T. Hall
*Attorney, Agent, or Firm*—Richard J. Ancel

[57] ABSTRACT

A container lid composed of a plastic material comprising a main lid member and a slide member is disclosed, as well as a method of constructing and a mold for forming same. The main lid member has supporting guideways between which the slide member is situated, and the guideways are angled relative to the plane of the main lid member so as to hold the slide member on the lid. At least one aperture is provided for dispensing or collecting the container contents, the aperture being located at a point on the main lid member such that at least a portion of the slide member can be moved along the path between the guideways to a position covering the aperture. The slide member has: (1) a finger engageable portion for moving the slide between a closed position over the aperture and an open position in which the aperture is exposed; and (2) a formed recess which protrudes from its lower surface. The dimensions of the recess correspond substantially to the dimensions of the lid aperture for forming a tight-fitting lid closure when the slide member is in the closed position over the lid aperture.

14 Claims, 7 Drawing Figures

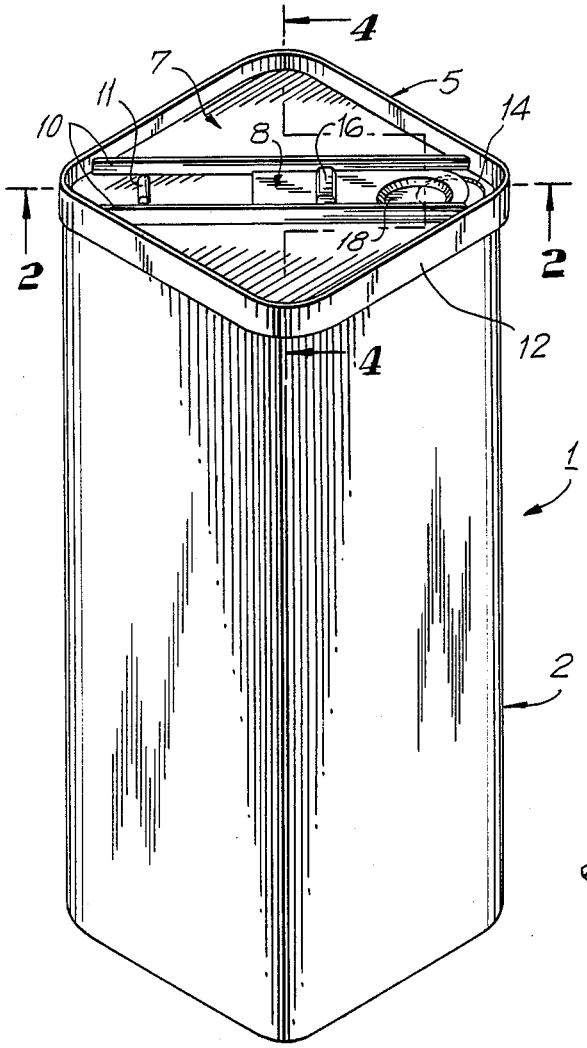
FIG. 1
FIG. 3
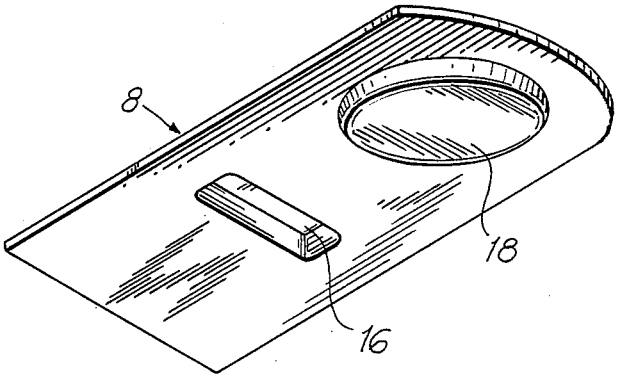
FIG. 2
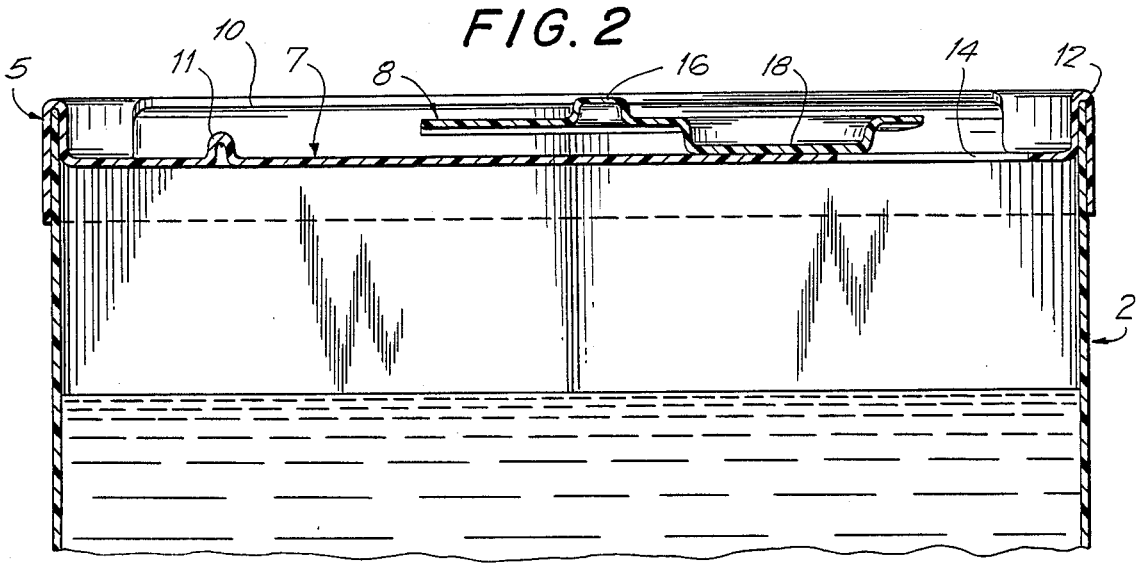

SLIDEABLE RECLOSABLE PLASTIC LID

BACKGROUND OF THE INVENTION

The present invention relates generally to plastic container lids. More particularly, the invention relates to plastic containers lids having a reclosing slide held in place by guideways on the lid, such a configuration providing a container with a reclosable opening.

The constructions of various reclosable containers are known in the art. Several of these constructions entail closures for metallic receptacles or cans. A sliding plate or cap is positioned between two rigid guideways or rails on the lid and can be moved into position over the aperture of the can to reclose the can after initial opening. Examples of these constructions include U.S. Pat. No. 949,974, issued to G. A. Cibulka, U.S. Pat. No. 1,273,012, issued to J. G. Souther, and U.S. Pat. No. 2,037,746, issued to W. J. Wardell. U.S. Pat. No. 4,127,212, issued to N. J. Waterbury, describes a rigid container having a rigid lid with a slidable cap held in place by rigid guideways, the lid and cap having interfacing seals to form an airtight container seal. The lids of these containers are assembled by first inserting the sliding plate between the guideways and then bending down the guideways so that they hold the plate in place on the lid while maintaining the plate's sliding capacity over the lid surface.

U.S. Pat. No. 3,368,798, issued to P. M. Garangiotis, describes a lid closure, which may be composed of plastic, having two separate lid members with a reclosing slide sandwiched between the members, the first member having an aperture and the second member having a removable portion containing a latch for reclosing the can.

In contrast, the present invention discloses a novel reclosable container lid composed of a plastic material and comprising a slide member and a main lid member having substantially parallel guideways between which the slide member is inserted. The guideways are preferably formed integrally with the main lid member.

The plastic lid of the invention has several advantages over those disclosed in the art. Due to its resiliency, the lid is better able to withstand damage during shipping and handling. The lid is also more economical to produce in terms of its plastic material than conventional metal lids. In addition, because it is composed of plastic, the lid can be produced by the process of thermoforming on unique thermoform molds. The ability to thermoform the lid of this invention allows production of the lid from a plastic sheet material composed of multiple barrier layers. Construction of the lid of the invention from such material improves the gas and oxygen resistance and sealing characteristics of the lid and permits tailoring of the barrier characteristics of the lid to match the barrier characteristics of the container body as well as the requirements of the container contents.

The present invention also provides a novel method of assembling the lid of the invention. Because of its flexible character, the sides of the lid can be bent down and inward causing the guideways to open up and allowing easy insertion of the slide member onto the main lid member surface. The slide member is thus inserted onto the lid after final angling of the guideways.

It is therefore a principal object of the present invention to provide a reclosable plastic container lid for use with a container body for holding or dispensing products such as beverages, condiments and other foods.

Another principal object of the invention is to provide a reclosable plastic container lid formed from thermoformable sheet material which has multiple barrier layers.

Another object of the invention is to provide a method of assembling the lid of the invention wherein the reclosing slide can be inserted onto the lid after formation and angling of the guideways on the lid surface.

Still another object of the invention is to provide unique thermoform molds for forming the reclosable lid of the invention.

SUMMARY OF THE INVENTION

The container lid of the invention is composed of a plastic material and comprises a slide member and a main lid member having supporting guideways angled relative to the plane of the main lid member for securing the slide member between the guideways on the lid surface. The lid also has at least one aperture for dispensing or holding the contents of the container.

The slide member has a finger engageable portion for moving the slide along a path between the guideways over the surface of the lid between a closed position over the lid aperture and an open position in which the aperture is exposed. The slide is provided with a formed recess which protrudes from the lower surface of the slide, the dimensions of the recess corresponding substantially to the dimensions of the lid aperture. The recess fits over the container aperture to form a lid closure when the slide is moved to the closed position.

According to one embodiment of the invention, the formed recess is of a depth sufficient to frictionally engage the inside perimeter of the aperture resulting in a tight lid closure. In order to achieve this friction fit, the perimeter of the recess is larger than the perimeter of the aperture by an order of from five to fifteen thousandths of an inch, preferably five thousandths of an inch on each side.

According to another embodiment of the invention, the formed recess of the slide is less deep or protruding. Instead, the angle between the guideways and the surface of the lid is made more acute in the area adjacent to the aperture than in the area away from the aperture, the slide being held tightly over the aperture by the angle of the guideways.

The manner of sealing the container aperture may determine which of the above-described embodiments is utilized. Containers utilizing the lid of the invention are typically sealed prior to initial opening by the end user. If the seal is composed of a thin material that is formed down into the aperture, such as a polyethylene/foil/polyester seal or a formed plastic seal, the frictionally engaging recess that sits in the aperture is preferred. If, however, the seal is of a type that does not form down into the aperture, for example, a polyethylene/saran/polyester seal, use of the less protruding recess in conjunction with the tightly angled guideways to hold the slide in the closed position is preferred to lessen the possibility that the recess may break the seal prior to use of the container.

The slide member may be of any shape and thickness as long as it is movable between the guideways of the lid and of a sufficient area to cover the lid aperture when moved to the closed position.

The main lid member comprises the supporting guideways, at least one lid aperture, and a preferably raised rim or flange around the periphery of the lid.

The supporting guideways of the lid are preferably formed integrally with the main lid member and are positioned on the lid at an angle relative to the plane of the lid surface so as to secure the reclosing slide member to the lid while allowing free movement of the slide over the lid surface between the open and closed positions. The angle of the guideways may be uniform along the entire length of the guideways or, as discussed above, the angle may become progressively more acute as the guideways near the aperture to hold the slide securely over the lid opening. The plastic composition of the lid adds flexibility to the angle of the guideways enhancing movement of the slide (with its protruding lower surface) over the lid surface.

One set of guideways (comprising two substantially parallel tracks) can run the entire length of the lid or can run along only a portion of the length of the lid at a location on the lid adjacent to the aperture. Alternatively, several sets of guideways can be formed on the main lid member, for example, two sets of guideways situated end to end.

The lid aperture is located at a point on the main lid member such that at least a portion of the slide member can be moved along the path between the guideways to a position covering the aperture.

The main lid member has a flange or rim at its periphery for fitting over a container body of corresponding shape. The rim is preferably raised, for example, three sixteenths of an inch, above the level of the lid surface to provide a more leakage resistant container lid.

The main lid member can also be provided with a stop locating mechanism which acts to stop the movement of the slide at a particular location on the lid surface. According to one embodiment, the main lid member is provided with a slightly raised formed protrusion which engages an edge of the slide to stop its movement past the raised portion. Alternatively, the slide member can be provided with a recessed dimple which protrudes from its lower surface and which engages and fits into a correspondingly shaped recess formed on the main lid member to halt movement of the slide along the lid surface. The protrusion, or alternatively the recess, is situated on the lid at a point along the path of the slide such that when it engages the slide and halts its movement, the slide is in an open position.

The lid of the invention can be constructed from any formable plastic, for example, polyethylene, polypropylene, vinyl or polyester. The formable plastic may be of a uniform material or it may be composed of a blend of two or more resins such as nylon and polyethylene.

In addition, the lid can be formed from a monolayer sheet material such as high density polyethylene or a multiple layer sheet material such as one consisting of an outer polypropylene layer, a barrier layer of ethylene vinyl alcohol and an inner sealing layer of polyethylene. The monolayer or multiple layer sheet material can additionally be provided with a barrier coating such as latex saran to improve the barrier properties of the material, particularly to oxygen.

The separate components of the lid, i.e., the main lid member and the slide member, can be formed by any suitable means known in the art, for example, injection molding. According to a preferred embodiment of the invention, however, the members are formed by the process of thermoforming on molds corresponding in shape and dimensions to the configurations of the respective members. The molds can be composed of any suitable material such as aluminum.

According to one embodiment of the invention, the mold for forming the main lid member comprises a generally planar surface having elongated rails extending upward from the surface of the mold for forming the supporting guideways of the main lid member. The rails of the mold are set at an angle relative to the plane of the mold, the angle being determined based on such factors as the amount of friction fit desired between the slide member and the aperture of the finished lid, the thickness of the slide, the composition of the lid, and the diameter or configuration of the lid. Thus, during the process of thermoforming the lid, the plastic guideways of the finished lid are formed on the mold at a predetermined angle sufficient to hold the slide on the finished lid while permitting easy movement of the slide along the path bounded by the guideways.

In addition, the mold is provided with at least one depressed region corresponding in dimensions to the aperture of the finished lid. The depressed region is located in an area of the mold defined by the rails, the area defined by the rails being that area bounded by the rails or the extension of the rails along an imaginary line along the length of the mold. The lid member formed on the mold is die cut to remove the plastic corresponding to the depressed region to produce the aperture of the finished lid.

According to one embodiment of the invention, the mold also has a protrusion on its upper surface for forming the raised portion of the lid member that acts to stop movement of the slide at a position wherein the aperture is exposed.

The mold for forming the slide member of the lid comprises a generally planar surface having an outer shape and dimensions corresponding to those of the slide of the finished lid. The mold has a protrusion extending from its lower surface for forming the recess of the slide and a protrusion extending from its upper surface for forming the finger engageable portion of the slide.

The present invention also comprises a method of assembling the lid of the invention. Due to the nature of the material from which it is made, i.e., its plastic composition, the lid of this invention can be assembled easily and at any stage of the production process. By applying pressure to the sides of the lid parallel to the guideways, the lid can be folded down and inward. This causes the guideways to open, extending upward, and the slide member can be easily inserted between them. Releasing the pressure on the lid permits the guideways to snap back into position over the slide member, securing the slide in place.

Other objects and features of the invention will be better understood from a consideration of the following detailed description of one preferred embodiment of the invention taken in conjunction with the accompanying drawings wherein like reference characters refer to like elements throughout.

BRIEF DESCRIPTION OF THE FIGURES

FIG. 1 is a perspective view of the lid according to a preferred embodiment of the invention, the lid being secured to a container body and the slide member of the lid being located such that the lid aperture is partially exposed.

FIG. 2 is a cross-sectional view of the lid according to a preferred embodiment of the invention as seen from section line 2—2 of FIG. 1, with the lid aperture partially exposed.

FIG. 3 is a bottom perspective view of the slide member according to a preferred embodiment of the invention.

DESCRIPTION OF A PREFERRED EMBODIMENT OF THE INVENTION

Figure 4:
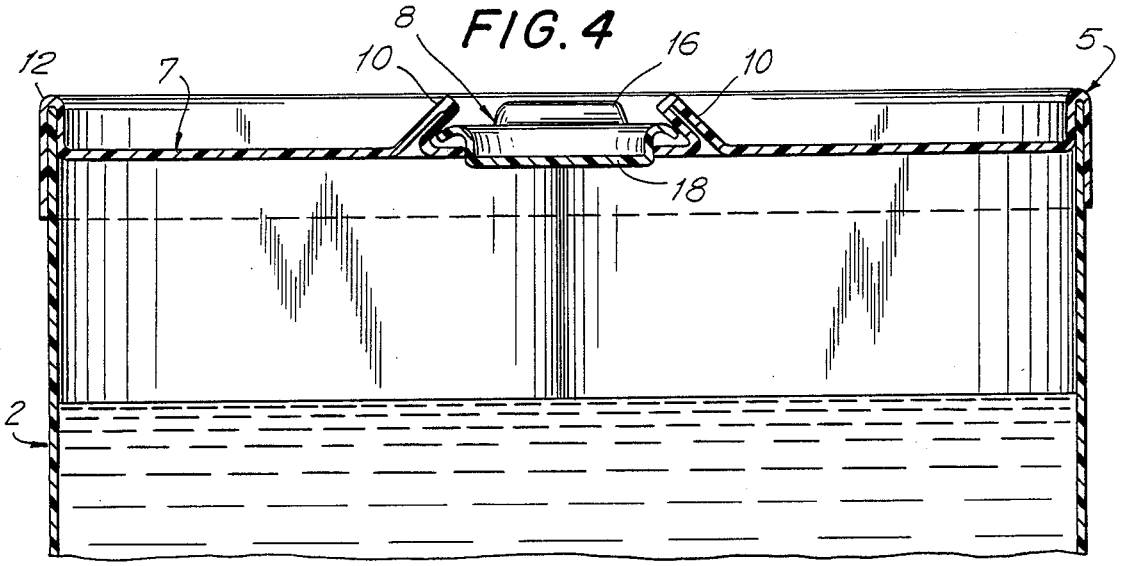
FIG. 4 is a cross-sectional view of the lid of the invention as seen from section line 4—4 of FIG. 1 with the slide member in the closed position over the lid aperture.

FIG. 1 shows a container 1 comprising a container body 2 and lid 5 of the invention. While container body 2 can be composed of any suitable material such as paperboard, lid 5 is constructed from any formable plastic material. It is to be understood that outer perimeter shape of the lid of the invention may vary from that depicted in this preferred embodiment.

Lid 5 comprises a main lid member 7 and a slide member 8. Two substantially parallel supporting guideways 10 are formed integrally with main lid member 7 and extend from one corner of the lid along a diagonal line to an opposing corner. Guideways 10 are angled relative to the plane of the lid surface so as to secure slide member 8 on lid 5 and allow movement of the slide over the lid surface. Main lid member 7 also has a raised flange 12 which borders the lid and is secured to container body 2. Lid 5 has an aperture 14 through which the container contents are dispensed or collected. FIG. 2 shows a cross-sectional view of lid 5 taken from a line parallel to and between guideways 10.

The container lid 5 is opened and closed by movement of slide member 8 along the path between guideways 10. This movement is accomplished by means of finger engageable portion 16 on slide member 8. To open lid 5, pressure is exerted on finger engageable portion 16 in a direction away from aperture 14 to move slide member 8 along the path between guideways 10, leaving aperture 14 exposed. Main lid member 7 is provided with a raised portion 11 which engages the edge of slide member 8 as the slide is moved away from aperture 14. Raised portion 11 acts to stop the movement of the slide member at a point at which the aperture is exposed. On first opening by the end user, a sealing tape (not shown) covering aperture 14 is removed after slide member 8 is retracted to expose the aperture.

Similarly, to close lid 5, pressure is exerted on finger engagement portion 16 of slide member 8 in a direction towards aperture 14. As depicted in FIG. 3, slide member 8 has a formed recessed portion 18 which protrudes from its lower surface and which fits into aperture 14 when slide member 8 is moved into position over the aperture. The depth of recessed portion 18 is such that it frictionally engages the inside perimeter of aperture 14 to form a tight-fitting closure. FIG. 4 is a cross-sectional view of lid 5 showing the friction fit of recessed portion 18 as it sits within aperture 14. It is to be understood, however, that the depth of recessed portion 18 and the angle of guideways 10 in the area of aperture 14 may be altered to provide closures of varying tightnesses.

Figure 5:
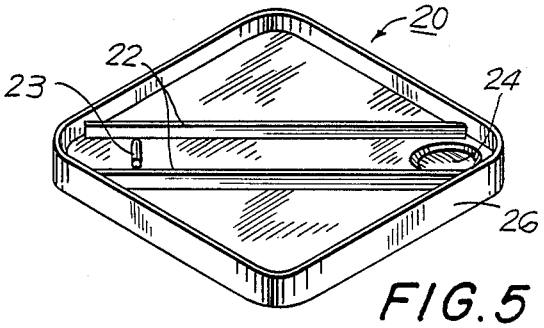
FIG. 5 is a perspective view of a mold for thermoforming the main lid member according to a preferred embodiment of the invention.

Main lid member 7 and slide member 8 are preferably formed by the process of thermoforming. This process allows formation of lid 5 from a multiple barrier layer plastic to provide a more durable container lid. FIG. 5 shows the mold 20 on which main lid member 7 is formed. Mold 20 corresponds in shape and most features to main lid member 7 and includes rails 22, depressed region 24, protrusion 23 and flange 26. The angle of rails 22 determines the angle of guideways 10 of lid 5. Recessed portion 24 corresponds in dimensions to aperture 14. After formation of main lid member 7 on mold 20, the outer perimeter of the plastic corresponding to recessed portion 24 is cut to produce aperture 14. Slide member 8 is similarly formed on a mold that corresponds in shape and features to the slide member depicted in FIG. 3.

Figure 6:
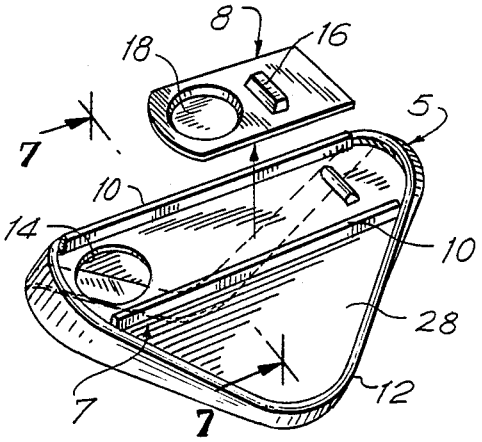
FIG. 6 is a perspective view of the lid of the invention during assembly.
Figure 7:
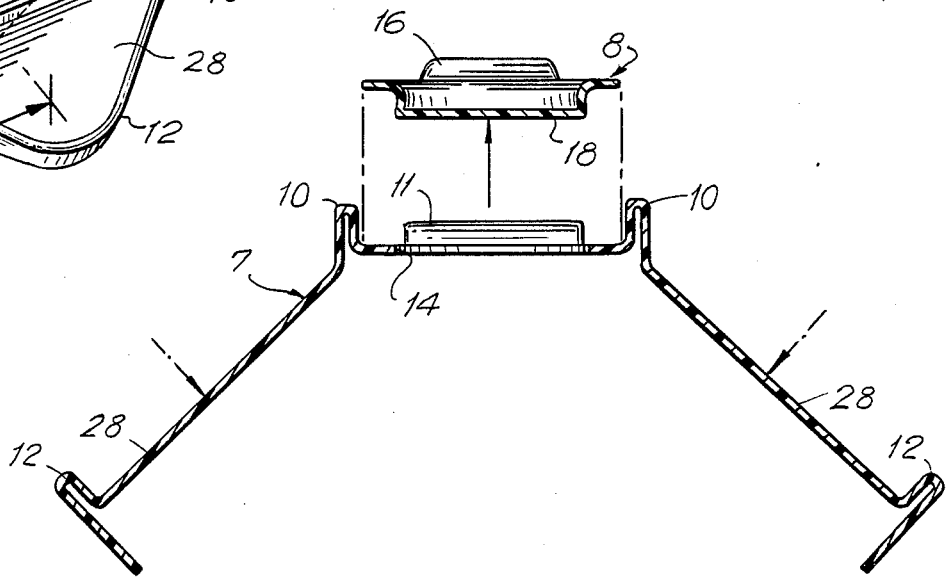
FIG. 7 is a cross-sectional view of the lid of the invention during assembly as seen from section line 7—7 of FIG. 6.

The method of assembling lid 5 is depicted in FIGS. 6 and 7. Pressure is applied to main lid member 7 at points on either side of guideways 10, resulting in a bending of the sides 26 downward and inward. This bending causes the angled guideways 10 to open and extend upward, allowing easy insertion of slide member 8 between the guideways. The plastic composition of lid 5 allows guideways 10 to snap back into their original angle when the pressure on sides 26 is removed.

While we have hereinbefore presented a number of embodiments of this invention, it is apparent that our basic construction may be altered to provide other embodiments which utilize the compositions and methods of this invention. For example, while lid 5 and container body 2 have been illustrated as being square with radiused corners, it is obvious that other shapes, such as circular and oval, may be utilized within the spirit and scope of this invention. Therefore, it will be appreciated that the scope of this invention is to be governed by the claims appended hereto rather than the specific embodiments which have been presented hereinbefore by way of example.

What is claimed is:

1. A container lid composed of a plastic material comprising a main lid member and a slide member, the main lid member having supporting guideways between which the slide member is situated, the guideways being angled relative to the plane of the main lid member so as to hold the slide member on the lid and at least one aperture for dispensing or collecting the container contents, the aperture being located at a point on the main lid member such that at least a portion of the slide member can be moved along the path between the guideways to a position covering the aperture, the slide member having a formed recess which protrudes from its lower surface, the dimensions of the recess corresponding substantially to the dimensions of the lid aperture for forming a tight-fitting lid closure when the slide member is in the closed position over the lid aperture, and the slide member having a finger engageable portion for moving the slide between a closed position over the aperture and an open position in which the aperture is exposed.

2. The container lid according to claim 1, wherein the slide member has a formed recess which protrudes from its lower surface, the dimensions of the recess corresponding substantially to the dimensions of the lid aperture for forming a tight-fitting lid closure when the slide member is in the closed position over the lid aperture.

3. The container lid according to claim 1, wherein the perimeter of the formed recess is somewhat larger than the inside perimeter of the aperture to form a friction fit when the slide member is in the closed position over the aperture.

4. The container lid according to claim 1, wherein the main lid member has a raised portion positioned on the lid to engage an edge of the slide member and stop the movement of the slide at that location on the lid.

5. The container lid according to claim 1, wherein the slide member has a protrusion on its lower surface for engagement with a correspondingly shaped recess formed on the main lid member to halt movement of the slide member along the lid surface upon engagement of the protrusion and the recess.

6. The container lid according to claim 1, wherein the main lid member has a raised flange at its periphery for fitting over a container body of corresponding shape.

7. The container lid according to claim 1, wherein the supporting guideways are continuous and extend substantially completely across the surface of the lid.

8. The container lid according to claim 1, wherein the supporting guideways are spaced intermittently along the surface of the lid.

9. The container lid according to claim 1, wherein the angle between the supporting guideways and the surface of the lid is more acute in the area adjacent to the aperture than in the area away from the aperture.

10. The container lid according to claim 1, wherein at least two substantially parallel supporting guideways are positioned on the lid at an angle relative to the surface of the lid so as to slidably engage the sides of the slide member situated between them.

11. The container lid according to claim 1, in which the aperture is located at a point near the outer boundary of the lid and between a set of substantially parallel guideways extending from the boundary of the lid adjacent to the aperture to an opposing boundary of the lid, the angle between the guideways and the surface of the lid being more acute in the area adjacent to the aperture than in the area away from the aperture.

12. The container lid according to claim 1, wherein the plastic material from which the lid is formed is a multiple barrier layer sheet material.

13. The container lid according to claim 1, wherein the plastic material from which the lid is formed is composed of two or more resins.

14. The container lid according to claim 1, wherein the main lid member and slide member are formed by the process of thermoforming on molds corresponding in shape to the configurations of the respective members.

* * * * *